United States Patent [19]

SinghDeo

[11] Patent Number: 4,756,754

[45] Date of Patent: Jul. 12, 1988

[54] CERMET COMPOSITE

[75] Inventor: Narendra N. SinghDeo, Menlo Park, Calif.

[73] Assignee: Olin Corporation, New Haven, Conn.

[21] Appl. No.: 22,895

[22] Filed: Mar. 6, 1987

[51] Int. Cl.[4] ..... C22C 29/02; C22C 29/12; C22C 29/16

[52] U.S. Cl. ..... 75/233; 75/235; 75/237; 75/244

[58] Field of Search ..... 75/231, 233, 234, 235, 75/237, 244

[56] References Cited

U.S. PATENT DOCUMENTS

| | | | |
|---|---|---|---|
| 3,892,600 | 7/1975 | Smeggil et al. . | |
| 4,569,692 | 2/1986 | Butt . | |
| 4,656,499 | 4/1987 | Butt | 357/74 |
| 4,711,665 | 12/1987 | Simkovich . | |
| 4,715,892 | 12/1987 | Mahuliker . | |

OTHER PUBLICATIONS

"A Method for Fabrication of Aluminum-Alumina Composites", by B. F. Quigley et al., American Society For Metals and the Metallurgical Society of AIME, Metallurgical Transactions A, vol. 13A, Jan. 1982.

*Primary Examiner*—John F. Terapane
*Assistant Examiner*—Eric Jorgensen
*Attorney, Agent, or Firm*—Gregory S. Rosenblatt; Paul Weinstein

[57] ABSTRACT

The present invention relates to a composite formed of a mixture of ceramic particles and at least two metallic components adhered together with a glassy phase. A first of the metallic components, in particle form, enhances the flow characteristics of the mixture where the second metallic component and the glass are in the molten condition. The final composite is a continuous phase of the second metallic component having particles of the first metallic component and glass coated ceramic particles distributed therein.

8 Claims, No Drawings

CERMET COMPOSITE

While the invention is subject to a wide range of applications, it is especially suited for use in a broad range of applications incorporating electro-ceramics and engineering ceramics. The invention discloses the bonding together of ceramic, glass and two types of metallic particles to form a coherent composite with desired properties which may be specifically tailored for specific applications such as packaging of electronic components, artificial body parts, grinding wheels, engine parts, and ceramic engines, to name a few.

This application relates to U.S. Pat. No. 4,569,692, entitled LOW THERMAL EXPANSIVITY AND HIGH THERMAL CONDUCTIVITY SUBSTRATE, by S. H. Butt; U.S. patent application Ser. No. 838,866, entitled CERMET SUBSTRATE WITH GLASS ADHESION COMPONENT, by D. Mahulikar (now abandoned); U.S. patent application Ser. No. 838,967, entitled CERMET SUBSTRATE WITH SPINEL ADHESION, by M. J. Pryor et al.; U.S. patent application Ser. No. 924,968, entitled CERAMIC-GLASS-METAL COMPOSITE, by Mahulikar et al.; U.S. patent application Ser. No. 924,959, entitled PRODUCTS FORMED OF CERAMIC-GLASS-METAL COMPOSITES, by N. N SinghDeo et al.; U.S. patent application Ser. No. 924,970, entitled ELECTRIC PACKAGING OF COMPONENTS INCORPORATING A CERAMIC-GLASS-METAL COMPOSITE, by N. N. SinghDeo et al.; U.S. patent application Ser. No. 707,636, entitled PIN GRID ARRAYS, by M. J. Pryor (now abandoned), corresponding to EPO Publication No. 0193782; U.S. patent application Ser. No. 4,469 entitled CERAMIC-GLASS-METAL PACKAGING FOR ELECTRONIC COMPONENTS INCORPORATING UNIQUE LEAD-FRAME DESIGNS, by Butt et al. and U.S. Pat. No. 4,715,892, entitled CERMET SUBSTRATE WITH GLASS ADHESION COMPONENT, by D. Mahulikar.

The present invention is directed to composite materials called cermets. As the term indicates, they include mixtures of metals and ceramics. The advantage of using this material over metal for a comparably sized substrate is its increased rigidity and lighter weight. As compared to ceramic substrates, it has a significantly higher coefficient of thermal expansion and thermal conductivity and can be electrically conductive. Also, the cermets are fabricated at a much lower temperature than that required for ceramic sintering, i.e. about 1600° C. and the processing cost is typically lower. Further, the CTE and the thermal conductivity of the cermet can be selected over a relatively large range of values. The problem has been that, up until now, the cermet materials were not easily bonded together to form a rigid structure as required for electronic applications.

A process of producing aluminum-alumina composites has been described in an article entitled "A Method for Fabrication of Aluminum-Alumina Composites" by B. F. Quigley et. al., American Society For Metals And The Metallurgical Society Of AIME, Metallurgical Transactions A, Volume 13A, January 1982. This article discloses that alumina fibers can be incorporated in Al-Mg matrices and that complete wetting and bond formation are achieved. The process incorporates casting technology whereby the ceramic fibers are mixed into molten Al-Mg. Then about 50 to about 70 percent of the aluminum is squeezed out of the mixture through a ceramic filter. The resulting mixture has a maximum of about 23 vol. % of alumina particles in a matrix of Al-Mg. The article also stated that substantial fiber breakage occurred when the fibers in the starting material were at a level of about 10 to 20 vol. percent. Therefore, the breakage was kept to a minimum by compressing composite material containing fibers in the range of 5 to 10 vol. percent. This article describes a process which is quite different from that of the present invention. First of all, the present invention uses powder metallurgy technology and is thereby able to achieve substantially higher percent volumes of ceramic particles within the alloy matrix. These higher volumes may be extremely important for applications, such as, for example, adjusting the coefficient of thermal expansion of the mixture to be compatible with that of copper alloy material which is typically used for leadframe construction in semiconductor packaging applications. Also, the amount of alloying particles being added to the aluminum is within a restricted range in order that the thermal conductivity of the final composite is high. The size of the ceramic particles is also preferably small in order that the resulting composite will have a smooth finish in order that it be suitable for electronic applications.

The ceramic-metal (cermet) composites have also been formed by one-step processes as described in U.S Pat. No. 4,715,892. This technique proved effective for many applications. However, as the final product required a higher percentage of ceramic particles and/or a more complex shape, the higher pressure needed to form the composite within the mold resulted in the molten glass and the molten metal between the ceramic particles being squeezed out and interlocking of ceramic particles. The result is a retardation of further flow so that the densification and shaping of the composite to the desired final configuration requires more pressure or may not be possible. The present invention overcomes this problem by combining two types of metallic components with the ceramic particles and the glass. One of the metallic components forms a continuous phase containing particles of the second metallic component and glass coated ceramic particles distributed therein. Particles of the second metallic component enhance the flow characteristic of the composite material and have limited diffusivity in the first metallic component.

The composite may be formed of a combination of materials such that it is either electrically conductive or non-electrically conductive. Also, the coefficient of thermal expansion may be regulated in accordance with the requirements of the specific application.

A composite having a low coefficient of thermal expansion, while being non-electrically conductive, is particularly useful in the component electronics industry. Presently, low expansivity materials are widely used in the microelectronic industry as substrate materials for semiconductor packages, hybrid circuit packages and chip carriers. These materials are particularly useful when the coefficient of thermal expansion (CTE) of the substrate is critical, i.e. when silicon chips or low expansivity leadless chip carriers are mounted directly to the substrate.

The present invention provides a unique method of manufacturing cermet structures to their final configuration in a one-step process by conventional means at temperatures well below the firing temperature of either the conventional ceramics, i.e. about 1600° C., or even "low fired ceramics", i.e. about 900° C. The present process also imparts unique properties to the manufactured product because organics are not necessarily required in the manufacturing process.

It is a problem underlying the present invention to manufacture a composite material whose physical characteristics can be tailored to provide specific mechanical, electrical, thermal, and chemical properties.

It is an advantage of the present invention to provide a composite material and method of forming the composite material which obviates one or more of the limitations and disadvantages of the described prior arrangements.

It is a further advantage of the present invention that a composite material and method of forming the composite material adapted to form a substrate having good flexure strength is provided.

It is a still further advantage of the present invention that a composite material and method of forming the composite material which can produce articles with a tight tolerance is provided.

It is another advantage of the present invention that a composite material and method of forming the composite material at a relatively low firing temperature is provided.

It is yet another advantage of the present invention that a composite material and method of forming the composite material capable of being formed in a single step is provided.

Accordingly, there has been provided a composite and the process of forming the composite. The unique composite material comprises ceramic particles, two metallic components and a glass being adherent to both the glass and the metallic components. The glass coats the ceramic particles and bonds to both the metallic components and to the ceramic particles. One of the metallic components forms a continuous phase throughout said composite material. The other metallic component is in particle form to enhance the flow characteristics of the composite material and is distributed through the composite material. The composite material may be formed in a single step, by methods including hot forging and hot pressing in a mold.

The present invention particularly relates to a composite formed of a mixture of ceramic particles and at least two metallic components adhered together with a glassy phase. The composite can formed by conventional processes such as hot forging and hot pressing into any desired shape at a processing temperature where the selected glass and one of the metallic components is preferably in the fluid condition while the other metallic component and ceramic are particles which remain in the solid condition. The resulting shaped composite may be electrically conductive or non-conductive, have a wide range of coefficients of thermal expansion, and different degrees of strength and toughness. In general, the cermet of the present invention is tougher because of the increased ceramic content.

The invention involves mixing together appropriate proportions of at least four different types of materials to provide selected properties. One of the materials is a ceramic powder which is present in a volume percent range selected according to the desired physical property requirements such as the mechanical, electrical, thermal and chemical properties. Typically, ceramics are known for their physical characteristics including high strength, low ductility, high dielectric constant, low coefficient of thermal expansion and chemical non-reactivity. The second material is a glass which forms a matrix for binding the ceramic and metallic particles together. Since glass is relatively fragile, it is typically provided at such a proportion so as to prevent a significant reduction of the composite strength, primarily provided by the ceramic particles. The glass is selected to be chemically reactive with the ceramic particles as well as with the other materials, metal or alloy components. One of the metal or alloy components is comprised of metal or alloy particles which are dispersed throughout the composite. The metal or alloy particles enable the ceramic particles to shift position, while the composite is being pressed into a desired shape at the processing temperature, with less applied pressure as compared to a cermet slurry alone. In addition, the metal or alloy particles improve the thermal conductivity of the composite. The metal or alloy particles are preferably soft and ductile. It is believed that they tend to mold onto the adjacently disposed surfaces between adjacent ceramic particles so that the ceramic particles can slide over each other during the forming process without being damaged. It is also believed that the metal particles substantially reduce the occurrence of interlocking between ceramic particles thereby reducing the pressure necessary for forming the final shapes. The other metal or alloy component forms a continuous phase having the glass coated ceramic particles and the metal or alloy particles distributed therein. The resulting composite is particularly useful in that it may be readily formed by a one step process into a complex, final shape having a very tight tolerance.

The ceramic material typically comprises particles selected for their physical characteristics. The specific ceramic may be selected from the group consisting of $Al_2O_3$, SiC, BeO, $TiO_2$, $ZrO_2$, MgO, AlN, $Si_3N_4$, BN and mixtures thereof. The present invention is not limited to these ceramics and may incorporate any desired ceramic or mixture of ceramics. The ceramic particles are present in a range of from about 30 to about 80 volume percent of the final fired composite and in a preferred range of from about 40 to about 65 volume percent. The ceramic particles can have any desired shape and have an average diameter of over about 1 micron, preferably, between about 1 to about 200 microns and most preferably, between about 40 to about 100 microns. The factors considered in selecting the desired ceramic include its dielectric constant, its coefficient of thermal expansion, its strength and chemical durability.

Conventionally, ceramics have been chosen for their high temperature capabilities since their melting point is at a temperature from about 1300° to about 2500° C. However, the present invention may not require the high temperature capabilities since the ceramic particles are bonded together in a glassy matrix which may have a relatively low softening temperature as compared to that of the ceramic. It is also within the terms of present invention to choose glasses which can be fabricated into components that are stable at very high temperatures.

A second component of the composite comprises a glassy phase having any desired composition in accordance with the properties required by the final composite. The glassy phase functions to bind the ceramic and metallic particles together within a matrix of the glass. An important characteristic is that the glass preferably is chemically reactive with both the ceramic and metallic components. Also, it may be important that the glass has physical characteristics such as good chemical durability, high strength, an acceptable dielectric constant, and a softening point in a selected temperature range. Suitable glasses may be selected from the group consisting of silicate, borosilicate, phosphate, zinc-borosilicate, soda-lime-silica, lead-silicate, lead-zinc-borate glasses. However, any desired glass may be utilized. They may include phosphate glass systems having high coefficients of thermal expansion and relatively low temperature softening points. In addition, a vitreous or devitrified glass may be selected.

A preferred example of a useful glass which provides thermosetting properties suitable for application in an electronic environment is a devitrified, solder glass. This glass is a $PbO-ZnO-B_2O_3$ type glass and has a nominal composition of about 10 wt. % B, 0.025 wt. % A, 8.5 wt. % Si, 0.04 wt. % Ti, 0.01 wt. % Fe, 8.5 wt. % Zn, 12.5 wt. % Zr, 0.25 wt. % Hf, 2.0 wt. % Ba and the balance Pb. All elements are reported as wt. % of corresponding oxide. After the glass is liquid, it is held at a temperature of about 500° C. for about 10 minutes. The glass, upon solidification, then devitrifies. At that point, it will not remelt until it reaches a temperature of about 650° C.

The glass is present in an effective amount up to about 10 volume percent of the fired composite in a preferred range of from about 1 to about 9 volume percent. The glass is preferably selected with a softening temperature from about 300° to about 1300° C. The processing temperature is selected so that the glass is at least above its softening point and preferably in the liquid state.

A thermosetting composite may be formed by mixing ceramic particles and the metallic components with a glass that devitrifies above a certain temperature. First, the composite is preferably formed at a processing temperature where the glass is in a liquid condition. The composite may then be held in an oven at approximately the processing temperature for a sufficient period so that it has a devitrified structure when it solidifies. When the glass is in the crystalline state, it is usually much stronger than in the vitreous state. A composite of this nature, i.e. ceramic particles, a metallic continuous phase and metallic particles mixed with a devitrified glass, may be characterized as a thermosetting material. The latter characteristic is imparted because the remelting temperature is considerably higher than the original processing temperature.

For example, a devitrifiable solder glass, CVIII manufactured by Owens Illinois Co., becomes liquid at a processing temperature of about 470° C. This glass, as previously described, is a $PbO-ZnO-B_2O_3$ type glass and has a nominal composition of about 10 wt. % B, 0.025 wt. % A, 8.5 wt. % Si, 0.04 wt. % Ti, 0.01 wt. % Fe, 8.5 wt. % Zn, 12.5 wt. % Zr, 0.25 wt. % Hf, 2.0 wt. % Ba and the balance Pb. All elements are reported as wt. % of corresponding oxide. After the glass is liquid, it is held at a temperature of about 500° C. for about 10 minutes so that upon solidification it has a devitrified structure. Once devitrified, it will not remelt until it reaches a temperature of about 650° C. The thermosetting characteristics of the devitrified glasses are particularly advantageous because they allow the final product to be used in a higher temperature environment than the original processing temperature.

A third component is a metal or alloy which forms a continuous phase in the final fired composite. The metal or alloy is preferably mixed in particulate form, being sized from about 3 to about 100 microns and preferably from about 3 to about 25 microns. The volume % of the metal or alloy is about 5 to about 30 volume % and preferably from about 20 to about 30 volume % of the final fired composite. It is within the terms of the present invention to select a metal or alloy which chemically reacts with the selected glass to form a strong bond. The metallic particles of the third component are preferably selected from the group consisting of aluminum, copper, nickel, titanium, chromium, iron, silver, gold and alloys thereof. The invention is not limited to these metals and alloys and may include any metal or alloy particle which chemically bonds to the selected glass and has limited diffusivity in the fourth metal or alloy component.

A fourth component of the composite comprises metallic particles which preferably are ductile at the processing temperature. These metallic particles significantly reduce the pressure necessary to densify the final composite product. It is believed that they mold about the surfaces of the ceramic particles when they are pressed between the ceramic particles during the processing procedures to reduce or eliminate interlocking of the ceramic particles and reduce the required processing pressures. For example, the usual processing includes heating the mixture of ceramic particles, the third component comprising metal or alloy particles, the glass and the fourth component comprising metallic particles to the processing temperature. At the processing temperature, the glass and the third component are in the liquid state while where the metallic particles of the fourth component are soft and ductile but not molten. The resulting composite slurry may be formed, i.e. in a mold. As slurry flows into the shape of the mold, the ceramic particles are pressed against each other. The glassy phase is squeezed out from between adjacent ceramic particles causing points of contact. Without the presence of the metallic particles, the ceramic particles would remain in contact and could lock in position and thereby retard the ability of the slurry to flow. The ease of flowability is required for densification and shaping of the composite to the desired final configuration. Any loss of flowability becomes increasingly significant as the final shape becomes more complex.

A unique aspect of the present invention is the addition of the metallic particles of the fourth component into the composite to significantly improve the flowability of the composite slurry. The metallic particles act as a lubricant to enable the ceramic particles to slide over each other. It is believed that some of the metallic particles move into the interstices between adjacent ceramic particles and mold onto the ceramic particles at the points of contact which could interlock. These metallic particles, being squeezed by the ceramic particles moving towards each other, adhere to the ceramic particles and then deform. This deformation enables the slurry containing the ceramic particles to move and flow, i.e. in a mold, while preventing damage to the ceramic particles.

The metallic particles of the fourth component may be constituted of any metal or alloy which does not melt at the processing temperature of the composite. In addition, the metal or alloy of the third component preferably has limited diffusion in the metal or alloy of the fourth component. The degree of diffusion may be effected by the size of the metallic particles constituting the fourth component. For example, the metals and alloys may be selected from the group consisting of chromium, molybdenum, tungsten, tantalum, niobium and alloys thereof. Preferably, the selected metals and alloys are ductile at the processing temperature. Since any metal or alloy is ductile slightly below its melting temperature and below its solidus, respectively, a suitably selected processing temperature enables the use of any metal or alloy which will be ductile at the latter temperature. Accordingly, it is within the terms of the present invention to use any metal or alloy for the fourth component which has the required ductility at the processing temperature and which can resist diffusion of the third metallic component to the extent required for the fourth component to remain at least partially intact with its selected physical characteristics. In the case where the metal or alloy is not ductile enough at the processing temperature, added pressure may be applied during the forming process to provide the required deformation. The metal or metal alloy particles preferably have an average diameter from about 0.01 to about 50 microns. The volume percent of the metal or alloy particles making up the fourth component is from about 5 to about 30 volume % and preferably from about 5 to about 15 volume %.

The specifics of an exemplary process of forming the cermet of the second embodiment of the invention preferably utilizes powder metallurgy technology. A mixture is formed of from about 20 to about 60 volume % of a metallic material. The metallic material consists of a first metal or alloy component comprising about 15 to about 30 volume % of the final fired composite preferably selected from the group consisting of aluminum, copper, nickel, titanium, chromium, iron, silver, gold and alloys thereof. The remainder of the metallic material consists of a second metal or alloy component which is not easily subjected to diffusion by said first metal or alloy component and is preferably selected from the group consisting of chromium, molybdenum, tungsten, tantalum, niobium and alloys thereof. Then, an effective amount up to about 10 volume % of binder in the form of glass particles for enhancing bonding between the metallic material and the ceramic particles is added. The glass is preferably selected from the group consisting of silicate, borosilicate, phosphate, zinc borosilicate, soda-lime-silica, lead-silicate and lead-zinc-borate glasses. Then, the balance of the mixture to form 100 volume % is added of ceramic particles. The ceramic particles are selected from the group consisting of $Al_2O_3$, AlN, $SiC_2$, BeO, $TiO_2$, $ZrO_2$, MgO, BN, $Si_3N_4$ and mixtures thereof.

In carrying out an exemplary process, the glass and ceramic particles are first mixed together by any means such as a V-type mixer so that the glass particles cover or coat the ceramic particles. Then, the glass covered ceramic particles are heated to the softening temperature, i.e. between about 350° to about 650° C. so that the glass fuses together and chemically interacts with the ceramic. Then, the glass coated ceramic particles are cooled. The resulting mass of glass coated ceramic particles are then ground to a size of between about 10 to about 100 microns and preferably from 10 to about 40 microns. Next, the glass covered ceramic particles are mixed with the first and second metal or alloy particles. This mixture is then compacted using a pressure of from about $15\times10^3$ to about $100\times10^3$ psi and preferably from about $40\times10^3$ to about $60\times10^3$ pounds per square inch (psi). Finally, the compact is heat treated by a process such as sintering, hot pressing or forging, at a temperature where both the glass and the first metal or alloy component is in the molten condition. It is also within the scope of the present invention to mix the first and second metallic components.

Although the present invention is described in terms of hot pressure forming, it is also within the terms of the present invention to form the ceramic-glass-metal composite using other techniques, such as those employed in glass manufacture, including casting, blow casting and blowing.

The patent, patent applications and articles set forth in this application are intended to be incorporated in their entireties by reference herein.

It is apparent that there has been provided in accordance with this invention a cermet composite which satisfies the objects, means and advantages set forth hereinabove. While the invention has been described in combination with the embodiments thereof, it is evident that many alternatives, modifications, and variations will be apparent to those skilled in the art in light of the foregoing description. Accordingly, it is intended to embrace all such alternatives, modifications and all variations as fall within the spirit and broad scope of the appended claims.

I claim:

1. A composite material, comprising:
from about 20 to about 60 volume % of metallic material;
from an effective amount up to about 10 volume % of glass; and
the balance essentially ceramic particles;
said glass coating said ceramic particles and bonding to both said metallic material and said ceramic particles;
said metallic material comprising first and second metal or alloy components, said first metal or alloy component comprising from about 5 to about 30 volume % of metallic particles for enhancing the flow characteristics of said composite material, and said second metal or alloy component comprising the remainder of metallic material and forming a continuous phase through said composite material with said metallic particles and the glass coated ceramic particles distributed therein.

2. The composite of claim 1 wherein said second metal or alloy component has limited diffusivity in said first metal or alloy component.

3. The composite of claim 2 further including said ceramic particles being selected from the group consisting of $Al_2O_3$, $AlN_2$, SiC, BeO, $TiO_2$, $ZrO_2$, MgO, BN, $Si_3N_4$, and mixtures thereof.

4. The composite of claim 3 further including said coating of glass being selected from the group consisting of silicate, borosilicate, lead borate, phosphate, soda-lime-silica, lead-silicate, lead-zinc-borate and zinc borosilicate glasses.

5. The composite of claim 4 wherein said second metal or alloy component is selected from the group consisting of aluminum, copper, iron, silver, gold, stainless steel and alloys thereof.

6. The composite of claim 3 including said ceramic particles having a size from between about 10 to about 100 microns.

7. The composite material of claim 2 wherein said first metal or alloy component is selected from the group consisting of chromium, molybdenum, tungsten, tantalum, niobium and alloys thereof.

8. The composite of claim 7 including said first metal or metal alloy having a size from about 3 to about 100 microns.

* * * * *